US010507997B2

(12) United States Patent
Himmelsbach et al.

(10) Patent No.: US 10,507,997 B2
(45) Date of Patent: Dec. 17, 2019

(54) DISPENSER FOR DISPENSING A TWO-LAYER ADHESIVE TAPE, AND METHOD FOR PRODUCING A TWO-LAYER ADHESIVE TAPE

(71) Applicant: TESA SE, Norderstedt (DE)

(72) Inventors: Peter Himmelsbach, Buxtehude (DE); Ute Ellringmann, Hamburg (DE)

(73) Assignee: TESA SE, Norderstedt (DE)

( * ) Notice: Subject to any disclaimer, the term of this patent is extended or adjusted under 35 U.S.C. 154(b) by 0 days.

(21) Appl. No.: 16/070,837

(22) PCT Filed: Jan. 17, 2017

(86) PCT No.: PCT/EP2017/050892
§ 371 (c)(1),
(2) Date: Jul. 18, 2018

(87) PCT Pub. No.: WO2017/125389
PCT Pub. Date: Jul. 27, 2017

(65) Prior Publication Data

US 2019/0039849 A1 Feb. 7, 2019

(30) Foreign Application Priority Data

Jan. 21, 2016 (DE) ..... 10 2016 200 810

(51) Int. Cl.
*B65H 35/07* (2006.01)
*B65H 35/00* (2006.01)
*B65H 37/00* (2006.01)

(52) U.S. Cl.
CPC ..... *B65H 35/0033* (2013.01); *B65H 35/004* (2013.01); *B65H 37/005* (2013.01);
(Continued)

(58) Field of Classification Search
CPC . B65H 35/0033; B65H 35/004; B65H 37/005
See application file for complete search history.

(56) References Cited

U.S. PATENT DOCUMENTS 4,415,400 A * 11/1983 Rammelmeyr ..... B65H 39/16 156/555
4,425,182 A * 1/1984 Jones ..... B65H 35/004 156/554

(Continued)

FOREIGN PATENT DOCUMENTS

DE 10 2006 009 866 B3 9/2007
DE 10 2012 204 594 A1 4/2013

(Continued)

OTHER PUBLICATIONS

International Search Report dated Mar. 31, 2017, mailed Apr. 10, 2017.

(Continued)

*Primary Examiner* — Mark A Osele
(74) *Attorney, Agent, or Firm* — Norris McLaughlin, P.A.

(57) ABSTRACT

Dispensers, systems and methods dispense strips of a first adhesive tape which have adhesive on both sides and on one side is covered with a liner. A first storage unit from which the first adhesive tape is drawn off is provided, and a second storage unit from which a second adhesive tape is drawn off is provided. A connection installation by means of which the first adhesive tape and the second adhesive tape are interconnected so as to form a two-ply adhesive tape is provided, and an application installation by means of which the two-ply adhesive tape as a composite is capable of being applied to a substrate is provided.

7 Claims, 1 Drawing Sheet

(52) U.S. Cl.
CPC ..... *B65H 2301/5161* (2013.01); *B65H 2701/1722* (2013.01); *B65H 2701/1864* (2013.01)

(56) References Cited

U.S. PATENT DOCUMENTS

| | | | | |
|---|---|---|---|---|
| 4,531,690 | A * | 7/1985 | Condy | B41J 32/00 242/594.5 |
| 4,981,537 | A * | 1/1991 | Heil | B65H 35/004 156/157 |
| 5,938,889 | A | 8/1999 | Hirano et al. | |
| 7,028,736 | B1 * | 4/2006 | Miller | B65H 35/004 156/304.1 |
| 7,921,896 | B2 * | 4/2011 | Andersen | B65H 35/004 156/527 |
| 9,457,983 | B2 | 10/2016 | Himmelsbach | |
| 9,861,315 | B2 | 1/2018 | Gretz et al. | |
| 2013/0020029 | A1 * | 1/2013 | Lazar | B65H 35/004 156/527 |
| 2014/0090785 | A1 * | 4/2014 | Nguyen | B65H 35/004 156/516 |
| 2014/0252021 | A1 | 9/2014 | Himmelsbach | |
| 2015/0075723 | A1 * | 3/2015 | Gibson | B65H 35/004 156/516 |
| 2015/0245799 | A1 | 9/2015 | Gretz et al. | |

FOREIGN PATENT DOCUMENTS

| | | | | |
|---|---|---|---|---|
| DE | 10 2012 018 076 | A1 | 3/2014 | |
| DE | 10 2013 018 289 | A1 | 4/2015 | |
| EP | 0 409 533 | A1 | 1/1991 | |
| FR | 2173453 | A5 * | 10/1973 | B65H 35/0033 |
| JP | 6 0137752 | U | 9/1985 | |
| JP | 2002-129115 | A | 5/2002 | |
| JP | 2015-083691 | A | 4/2015 | |
| WO | 97/08675 | A1 | 3/1997 | |
| WO | 00/66350 | A1 | 11/2000 | |

OTHER PUBLICATIONS

English Translation of International Search Report dated Mar. 31, 2017, mailed Apr. 10, 2017.

Chinese Office Action for corresponding Chinese Application No. 201780007549.5, dated Mar. 4, 2019.

Office Action dated Jul. 15, 2019, in connection with Korean Patent Application No. 10-2018-7023930.

Translation of Office Action dated Aug. 9, 2019 in connection with Japanese Patent Application No. 2018-538231.

* cited by examiner

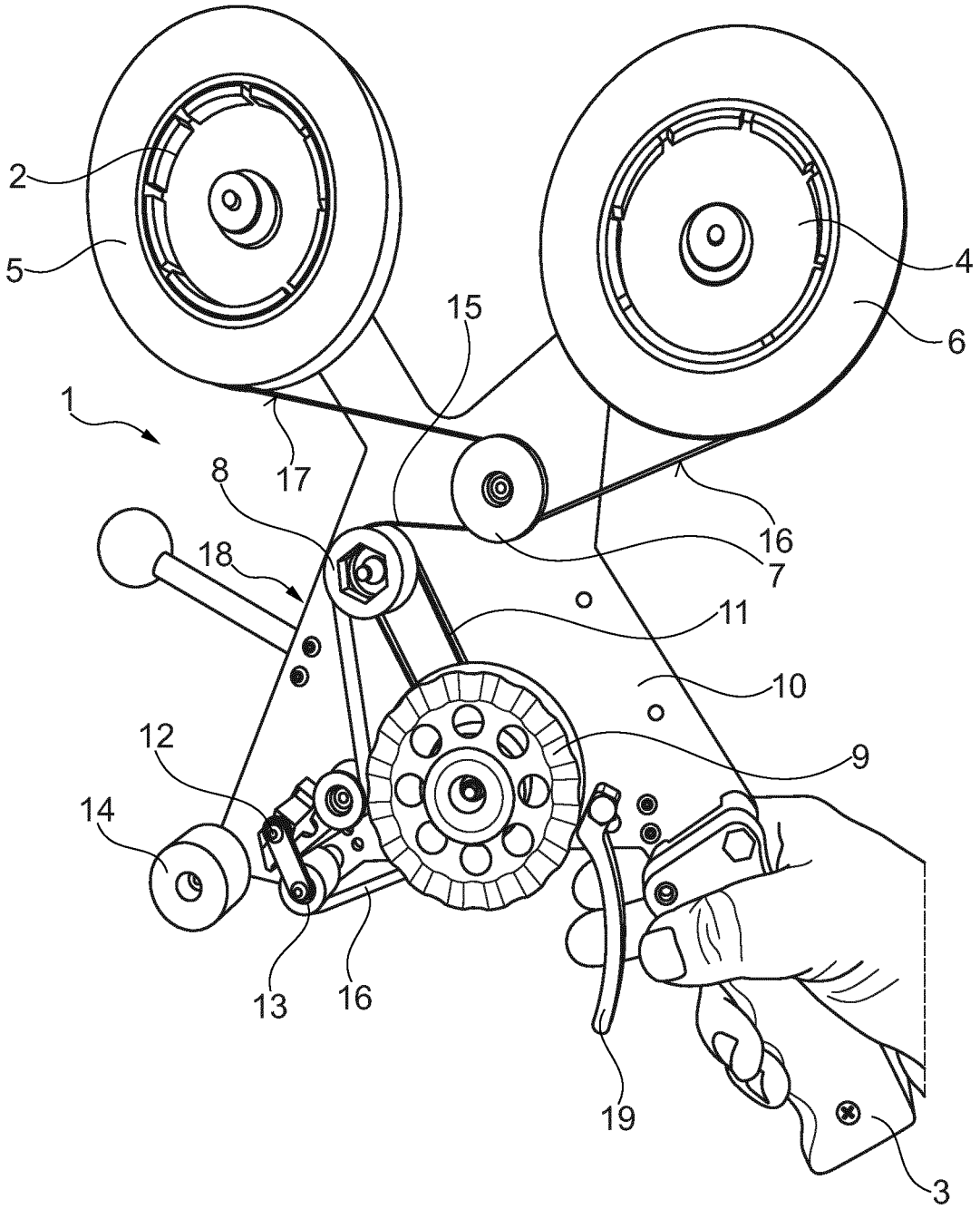
2
5
4
6
15
1
17
8
16
7
18
11
10
12
9
14
13
16
19
3

DISPENSER FOR DISPENSING A TWO-LAYER ADHESIVE TAPE, AND METHOD FOR PRODUCING A TWO-LAYER ADHESIVE TAPE

This application is a 371 application of PCT/EP2017/050892 filed Jan. 17, 2017, which claims foreign priority benefit under 35 USC 119 of German application 10 2016 200 810.2 filed Jan. 21, 2016.

The present invention relates to a dispenser, to an adhesive tape for adhesively bonding components, and to the adhesive bonding of two components.

Such dispensers may also be referred to as dispensing apparatuses for strip-shaped planar structures which are applied according to a preferred make up.

Adhesive tapes which are coated with adhesives on one side or both sides are in most instances wound up at the end of the production process so as to form a roll in the form of an Archimedean spiral on a core (of plastics material or paperboard). In order to prevent the adhesive compounds coming into contact with one another in the case of adhesive tapes which are adhesive on both sides, or in the case of adhesive tapes that are adhesive on one side to prevent the adhesive compound sticking to the carrier, a cover material (also referred to as a barrier material) which is wound up together with the adhesive tape is applied to the adhesive tapes prior to winding. A person skilled in the art will refer to cover materials of this type as release liners or liners.

A liner (barrier paper, barrier film) is not a permanent (durable) component part of the adhesive bond but only an auxiliary means of an adhesive tape in order for the latter to be produced, stored, or further processed such as, for example, by punching, plotter-cutting, or cutting. As opposed to an adhesive tape carrier, a liner is moreover connected in a reversible manner to an adhesive layer.

Double-sided adhesive tapes are used in various sectors. In an exemplary manner, the adhesive bonding of components from glass, metal, or plastics material to automotive bodies or to the add-on parts thereof are to be mentioned.

To this end, the components are equipped with the adhesive tape at the production site of the former. The liner typically remains on the adhesive tape and thus on the component until the component is to be adhesively bonded to the vehicle on the production line of the vehicle manufacturer. The liner is drawn off only immediately prior to the installation or in some cases after the preliminary assembly.

The application of the adhesive tape to said component can be performed manually, by way of hand-held applicators, or by way of partially or fully automatic devices, respectively. The most favourable method is chosen depending on the quantity, the extent of adhesive bonding, and parameters.

A manually activatable dispenser of this type, or else a hand-held applicator, is known, for example, from DE 10 2012 204 594 A1.

Hand-held applicators are used where a comparatively high precision in the application is required. The applicators in most instances have an integrated cutting device which, manually released, cuts through the adhesive tape and cuts to length the latter from the roll. In some cases the function of the applicator can be enhanced by pneumatic or electrical components such that specific requirements of individual customers can be met.

The production of small quantities of adhesive tapes having special properties is not always possible for economic reasons, even if said special properties are often required by customers. Combinations of different functions or properties which in technical terms, if at all, can only be implemented with very high complexity are often particularly critical herein.

Against this background the invention is based on the object of providing a dispenser of the generic type and an adhesive tape by way of which an improved adhesive bonding of components is possible, wherein the adhesive bonding and the adhesive tape are in particular to be better capable of being adapted to individual requirements.

In order for the object to be achieved according to the invention, a dispenser having the features described herein, an adhesive tape having the features described herein, and an adhesive bonding of two components, having the features described herein, are proposed. Further preferred refinements can be derived from the dependent claims, from the FIGURE, and from the associated description.

According to the fundamental concept of the invention it is proposed that a second storage unit from which a second adhesive tape is drawn off is provided on the dispenser, wherein a connection installation by means of which the first adhesive tape and the second adhesive tape are interconnected to form a two-ply adhesive tape is provided, and that an application installation by means of which the two-ply adhesive tape as a composite is capable of being applied to a substrate is provided.

On account of the solution according to the invention adhesive tapes having a greater thickness and, for example, having a significantly higher adhesive force than the single-thickness adhesive tapes used to date can be applied. In as far as the adhesive force is to be further increased, further adhesive tapes can be connected to the two-ply adhesive tape while using the same principle.

The two-ply adhesive tape can thus be considered to be a homogeneous adhesive tape having a comparatively great thickness, which by way of the dispenser is applied according to the identical principle as in the case of the single-thickness adhesive tapes to date, since connecting the adhesive tapes is performed directly on the dispenser, between the adhesive tapes being unwound and applied. The handling of the proposed dispenser differs from that of a conventional dispenser in that instead of one storage unit of one adhesive tape, additionally a second storage unit of a second adhesive tape is attached, and the second adhesive tape prior to being applied has to be threaded once in a corresponding manner. In the case of the proposed dispenser the connection installation which is provided thereon is particularly relevant, by means of which connection installation the two adhesive tapes are interconnected directly on the dispenser. Furthermore, the application installation provided on the dispenser is of particular importance, said application installation being disposed such that the two-ply adhesive tape is applied to the substrate as a composite, thus after the two adhesive tapes have been connected.

The second adhesive tape herein can preferably also be covered with a liner, wherein the first adhesive tape and the second adhesive tape by way of the free sides are interconnected in the connection installation, wherein one of the liners by means of a drawing-off installation is subsequently drawn off from the two-ply adhesive tape prior to the two-ply adhesive tape being applied to the substrate. The two adhesive tapes while using a liner are thus both wound up in the storage unit, and in a first step are initially interconnected by way of the free sides. The two-ply adhesive tape after being adhesively bonded is thus covered with a liner on both sides. One of the liners by means of the drawing-off installation is subsequently drawn off again from one side of the two-ply adhesive tape such that one of the two adhesive sides is exposed.

The adhesive tapes by way of the free sides that are not covered with the liners are placed on top of one another and adhesively bonded to one another. The two surfaces herein on account of the mutual penetration of the adhesive contained in the adhesive tapes thus establish a materially integral connection and, on account thereof, are laminated.

The adhesive tape herein can be better adapted to the individual requirements in particular in that the first adhesive tape and the second adhesive tape have dissimilar properties such as, for example, dissimilar thicknesses, dissimilar surface structures, dissimilar adhesive properties, dissimilar colourings or shapings, dissimilar markings or information carriers. It is thus possible, for example, for adhesive tapes having dissimilar overall thicknesses to be provided in that adhesive tapes of dissimilar thicknesses are interconnected which then collectively result in the required overall thickness. On account thereof, the overall thickness of the two-ply adhesive tape to be implemented can be achieved by the targeted choice of the thicknesses of the two adhesive tapes that are to be interconnected. In as far as components having a predetermined gap such as, for example, components of motor vehicles, are to be interconnected on account thereof, the predefined spacing of the interconnected components can be very exactly adhered to by dimensioning the overall thickness of the two-ply adhesive tape, this leading to a higher appeal of the components in terms of quality.

Furthermore, the adhesive tape on account thereof can be very easily provided with different surface properties, in particular adhesive properties, on the two different sides. A two-ply adhesive tape having different properties in the two plies can thus be implemented, said properties, if at all, being able to be realized in a single ply of an adhesive tape only with a very high complexity. In as far as additional properties are to be implemented in the adhesive tape, or a further even finer grading of the overall thickness is to be implemented, further adhesive tapes, in addition to the two plies of the individual adhesive tapes, can be connected by way of the two-ply adhesive tape. Multi-functional adhesive tapes having properties that are selected in a targeted manner can be applied in a particularly simple manner on account of the proposed refinement.

The second adhesive tape in particular can preferably be adhesive on one side, wherein the second adhesive tape in this instance is connected either by way of the adhesive surface to the first adhesive tape, or by way of the non-adhesive surface to the first adhesive tape. Depending on by way of which one of the sides the second adhesive tape is connected to the first adhesive tape, a thicker adhesive tape that is adhesive either on one side or on both sides can be achieved on account thereof.

A particularly strong connection between the plies of the two adhesive tapes can be achieved herein when the second adhesive tape is also adhesive on both sides. In this case, the adhesive for establishing the materially integral connection migrates between the adhesive tapes in both directions.

It is furthermore proposed that a third storage unit from which a functional layer is capable of being incorporated between the first adhesive tape and the second adhesive tape is provided. Such functional layers can be, for example, conductive layers or weak layers by way of which a targeted weak spot is achieved in a localized manner by way of a cohesive failure. The functional layer herein can penetrate one of the two interconnected adhesive tapes, or else be preserved as a separate layer between the two adhesive tapes of the two-ply adhesive tape. In as far as the functional layer is applied in the form of a strip between the adhesive tapes, or is applied to one of the adhesive tapes prior to the adhesive tapes being connected, a roll, for example, can be provided as the storage unit. Furthermore, a liquid dispenser can also be provided in as far as the functional layer is sprayed or otherwise applied as a liquid to one of the adhesive tapes.

It is furthermore proposed that a storage roll which is capable of being driven by a drive installation that is synchronized with the drawing-off movement of the first adhesive tape, of the second adhesive tape, or of the two-ply adhesive tape is provided, the liner that is drawn off from the two-ply adhesive tape being wound onto said storage roll. On account of the solution proposed, the liner that is drawn off is wound up again in a synchronous manner such that no jam or waste of the drawn-off liner is created on the dispenser, said jam or waste potentially impeding the handling of the dispenser. The synchronized drive movement of the storage roll herein is of particular relevance in the case of a corresponding dimensioning of the gear, since the quantity of liner that is wound up by the storage roll is identical to the quantity of the drawn-off liner, on account thereof.

The synchronized drive installation herein can be implemented in a particularly simple manner in that the drive installation has a drive wheel that for a rotating movement is driven by the drawing-off movement of the two-ply adhesive tape, the rotating movement of said drive wheel being transmitted to the storage roll by means of a gear. The advantage of this solution is to be seen in that the movement of the two-ply adhesive tape is utilized directly for driving the drive installation such that the rotating movement of the storage roll and of the drawn-off liner are also directly related to one another.

It is furthermore proposed that a cutting installation in which the two-ply adhesive tape having the liner disposed thereon, prior to being applied to the substrate, is cut in a dual-stage cutting process is provided, wherein the double-thickness adhesive tape including the liner disposed thereon is cut off in the first cutting step, and only the double-thickness adhesive tape is cut off in the second cutting step. The two-ply adhesive tape on account of the dual-stage cutting process in the cutting installation, comprising the two cutting steps proposed, is cut such that a projection of the liner is formed, said projection being able to be utilized as a gripping tab for releasing the liner from the two-ply adhesive tape that is applied to the substrate.

Furthermore, the first adhesive tape and/or the second adhesive tape can preferably be reactive adhesive tapes. The use of reactive adhesive tapes in the proposed dispenser is particularly advantageous since the two adhesive tapes are interconnected in the dispenser only directly prior to being applied, that is to say that the reaction to be initiated between the adhesive tapes takes place directly prior to the two-ply adhesive tape being applied to the substrate and in a temporal context to the latter.

At least one of the reactive adhesive tapes herein can have an adhesive compound which reacts with the adhesive compound of the respective other adhesive tape.

In as far as the time span between connecting the two reactive adhesive tapes and applying the latter is not sufficient, the first adhesive tape and the second adhesive tape, after having being connected to form the two-ply adhesive tape and prior to being applied to the substrate can be guided through an adhesive tape accumulator. An adhesive tape accumulator of this type can be, for example, a chicane that intentionally increases the running length, or a storage roll. The quantity of the two-ply adhesive tape between connecting and applying is intentionally enlarged on account of the extended running length. This enlarged quantity of the adhesive tape can accordingly also be referred to as an accumulated quantity.

A timer which displays the time span between connecting the two adhesive tapes and applying the latter can furthermore preferably be provided. Accordingly, a possibility of checking whether the time span is greater than a predefined time span required for the reaction of the adhesive tapes can be provided by way of the timer. In as far as the predefined time span is undershot, the operator can adhere to said time span again in a simple manner in that said operator reduces the drawing-off speed of the double-thickness adhesive tape until the predefined time span is exceeded again.

The invention will be explained hereunder by means of a preferred embodiment with reference to the appended FIGURE in which:

FIG. 1 shows a dispenser according to the invention having two storage units, each having one adhesive tape that is adhesive on both sides.

A dispenser 1 according to the invention, having a frame 10, a handle 3, and a hand lever 19, can be seen in FIG. 1. A first storage unit 2 and a second storage 4 of a first adhesive tape 5, adhesive on both sides, and of a second adhesive tape 6, adhesive on both sides, are provided on the frame 10. The storage units 2 and 4 are configured in the form of replaceable wound rolls which by means of a latching connection are fixed to rotatable mountings. The first adhesive tape 5 and the second adhesive tape 6 are in each case configured so as to be adhesive on both sides and are in each case covered on one side with a liner 16 and 17, respectively. The adhesive layers of the adhesive tapes 5 and 6 that are adhesive on both sides are separated from one another on the rolls by the liners 16 and 17, such that said adhesive tapes 5 and 6 cannot establish any connection and that the adhesive tapes 5 and 6 can be readily drawn off from the rolls.

After having been drawn off from the storage units 2 and 4, the adhesive tapes 5 and 6 are guided in a mutual alignment onto a deflection roller 7 in such a manner that the free adhesive sides of the adhesive layers face one another. The adhesive tapes 5 and 6 on the deflection roller 7 are then interconnected to form a two-ply double-thickness adhesive tape 15 which on both sides is covered with in each case one liner 16 and 17, respectively. This connection procedure is also referred to as laminating or covering. The deflection roller 7 and the infeed of the two adhesive tapes 5 and 6 having the free sides facing one another here form a connection installation which enables the two adhesive tapes 5 and 6 to be continuously connected to form a two-ply adhesive tape 15 after being unwound from the storage units 2 and 4 and prior to being applied to the substrate.

The two-ply double-thickness adhesive tape 15 is thus a composite from the first adhesive tape 5 and from the second adhesive tape 6, and has an overall thickness which corresponds to the sum of the thicknesses of the first adhesive tape 5 and of the second adhesive tape 6. In as far as the first adhesive tape 5 and the second adhesive tape 6 have dissimilar thicknesses, the overall thickness of the two-ply adhesive tape 15 of course does not correspond to the double thickness of one of the two adhesive tapes 5 or 6, but only to an enlarged thickness. For the sake of simplicity however, the term "double thickness" is to be further used hereunder so as to express the thickness of the two-ply adhesive tape 15 that is enlarged in relation to the two individual adhesive tapes 5 and 6.

In order for the two adhesive tapes 5 and 6 to come to lie on top of one another in a flush manner, the deflection roller 7 can have a lateral guide flange which moreover prevents the adhesive tapes 5 and 6 from being able to laterally run off the deflection roller 7. The adhesive tapes 5 and 6 herein can thus be precisely laminated to one another by way of a contact pressure in such a manner that a congruent connection of the adhesive tapes 5 and 6 that is free of air bubbles is created. In the further procedure, the double-thickness adhesive tape 15 is deflected on a second deflection roller 8 which simultaneously is a drive roller of a drive installation 18. The second deflection roller 8 by way of the gear 11, which here is formed by an endless belt drive, is connected to a storage roll 9 and drives the storage roll 9 for a synchronized rotating movement. The liner 16, after the deflection of the two-ply double-thickness adhesive tape 15 on the second deflection roller 8, is drawn off from one side of the two-ply double-thickness adhesive tape 15 and is wound onto the storage roll 9. Since the storage roll 9 by way of the drive installation 18 is driven by the adhesive tape 15 per se, the storage roll 9 herein carries out a movement that is synchronized with the movement of the two-ply double-thickness adhesive tape 15. An ideally slippage-free but nevertheless low-tension outward transportation of the liner 16 that has been released from the double-thickness adhesive tape 15 can be implemented by way of a corresponding dimensioning of the diameter of the storage roll 9 in the region of the bearing contact of the liner 16 to be wound up, and of the diameter of the second deflection roller 8 in the region of the bearing contact of the endless belt drive and in the region of the bearing contact of the two-ply double-thickness adhesive tape 15. In as far as the liner 16 is not to be wound up but is to be discharged into the environment, the storage roll 9 and the synchronized drive that is required on account of the former can also be dispensed with, on account of which the constructive design of the dispenser 1 can be significantly simplified. The storage roll 9, together with the drive installation 18 and the deflection roller 8, here forms a drawing-off installation by means of which the liner 16 is drawn off and wound up.

The drawing-off installation in the running direction of the adhesive tapes 5 and 6 is disposed so as to be downstream of the connection installation.

After the liner 16 has been released, the two-ply double-thickness adhesive tape 15 having the liner 17 that henceforth bears only on one side is guided further through a cutting installation having a blade 12 and a cutting roller 13 by way of a guide roller 14 onto the substrate to which the double-thickness adhesive tape 15 by way of the free adhesive side is adhesively bonded. In as far as the two-ply double-thickness adhesive tape 15 that is adhesively bonded to the substrate is to be additionally provided with a gripping tab, a dual-stage cutting installation which is described in DE 10 2012 204 594 A1 can of course also be provided. The dual-stage cutting installation described in DE 10 2012 204 594 A1 is thus to be expressly included in the disclosed content of this application. The cutting installation can be activated by the operator of the dispenser 1 by activating the hand lever 19.

Unwinding and applying the two-ply double-thickness adhesive tape 15 is performed in that the operator first sticks the double-thickness adhesive tape 15 by way of the free adhesive side to a substrate such as, for example, to a body part or to an add-on part. The double-thickness adhesive tape 15 herein, in a laterally guided manner, runs from the dispenser 1 by way of the guide roller 14, on account of which a very high application precision can be achieved. The guide roller 14 here forms an application installation which laterally guides the two-ply adhesive tape 15 when being applied and presses said two-ply adhesive tape 15 to the substrate.

The operator, after having stuck on the double-thickness adhesive tape 15, pulls the dispenser 1 in the application direction, wherein the double-thickness adhesive tape 15 is pulled through the cutting installation, over the second deflection roller 8 and the first deflection roller 7, and the two single-thickness adhesive tapes 5 and 6 are drawn off from the storage units 2 and 3. The double-thickness adhesive tape 15 herein is first produced directly on the dispenser 1 by laminating the two single-thickness adhesive tapes 5 and 6, having the liner 16 and 17, respectively, disposed on the one side of said single-thickness adhesive tapes 5 and 6, on the first deflection roller 7. The application procedure of the double-thickness adhesive tape 15 is then only terminated in that the operator activates the cutting installation by activating the hand lever 19, severing the double-thickness adhesive strip 15.

In as far as the two-ply double-thickness adhesive strip 15 is to be further thickened so as to form an even thicker adhesive strip 15, further layers of a single-thickness or double-thickness adhesive strip can of course be applied to the free surface and laminated thereto after the liner 16 has been separated from the one side of the adhesive strip 15.

Furthermore, additional functional layers can be incorporated between the two single-thickness adhesive strips 5 and 6 prior to laminating. Such functional layers can be, for example, conductive layers, information carriers, markings, barrier layers for achieving weak spots, reflective layers, planar light sources (OLEDs, for example), or the like. To this end, both or else only one of the single-thickness adhesive tapes 5 and 6 can be configured so as to be transparent such that the functional layers are subsequently identifiable in the double-thickness adhesive tape 15. The functional layer in this instance would be applied to one of the two adhesive tapes 5 or 6, or directly between the two adhesive tapes 5 and 6, prior to the two adhesive tapes 5 and 6 being laminated. The functional layer herein would expediently be held on the dispenser 1 on a third storage unit (not illustrated) in the form of a roll that is rotatably disposed on the dispenser 1, said functional layer in this instance being drawn off from the dispenser in a self-acting manner during the drawing-off movement of the double-thickness adhesive tape 15. Alternatively, the functional layer can also be applied or sprayed in liquid form from a storage unit that is configured as a liquid reservoir onto one of the adhesive tapes 5 or 6.

The two adhesive tapes 5 and 6 in terms of thickness can be dimensioned such that the overall thickness of the two-ply double-thickness adhesive tape 15 corresponds to a predefined thickness. Two-ply double-thickness adhesive tapes 15 having dissimilar overall thicknesses can thus be implemented and applied using the dispenser 1 by connecting individual adhesive tapes 5 and 6 of dissimilar thicknesses. The two adhesive tapes 5 and 6 herein, besides the dissimilar thicknesses, can alternatively have further dissimilar properties such as, for example, colourings and shapings, markings, or else adhesive properties. It is thus conceivable, for example, for one of the two adhesive tapes 5 or 6 to be embodied as a carrier film having a larger thickness and having a smaller quantity of adhesive substance, and for the other adhesive tape to be embodied having a smaller thickness and a larger quantity of adhesive substance, said adhesive substance then penetrating the carrier film and increasing the overall adhesive force of the two-ply adhesive tape.

Furthermore, one of the adhesive tapes 5 or 6 can also have properties such as, for example, colour changes, which vary in a pressure-sensitive manner such that the adherence to a specific contact pressure can subsequently be checked. To this end, functional layers which correspondingly vary in a pressure-sensitive manner can also be incorporated between the adhesive tapes 5 and 6.

It has been demonstrated that it suffices for an adequate adhesive force for the two-ply adhesive tape to have a width of more than 1 mm and of less than 50 mm. Two-ply adhesive tapes 15 having thicknesses between 0.03 mm and 8.0 mm can be implemented herein. In particular, adhesive bonds having a strength of more than 1 MPa can be produced by way of the adhesive tape according to the invention and the proposed dispenser, this not having been possible with conventional adhesive tapes.

According to the invention, the following installations are provided in the following sequence in the movement direction of the adhesive tapes 5 and 6 on the dispenser:

- a connection installation in which the two adhesive tapes 5 and 6 are connected,
- a drawing-off installation in which one of the liners is drawn off from the two-ply adhesive tape 15,
- a cutting installation in which the two-ply adhesive tape 15 is cut upon activation, and
- an application installation by means of which the two-ply adhesive tape is applied to the substrate.

The invention claimed is:

1. A dispenser configured for dispensing a strip of a first adhesive tape that is adhesive on both sides and on one side is covered with a liner, the dispenser comprising:
- a first storage unit from which the first adhesive tape is drawn off;
- a second storage unit from which a second adhesive tape is drawn off;
- a connection installation by means of which the first adhesive tape and the second adhesive tape are interconnected to form a two-ply adhesive tape;
- an application installation by means of which the two-ply adhesive tape as a composite is capable of being applied to a substrate; and
- a storage roll that is capable of being driven by a drive installation that is synchronized with the drawing-off movement of the first adhesive tape, of the second adhesive tape, or the two-ply adhesive tape is provided, wherein
- the liner which has been drawn off from the two-ply adhesive tape is wound onto said storage roll.

2. The dispenser according to claim 1, further comprising:
- a third storage unit from which a functional layer, which is capable of being incorporated between the first adhesive tape and the second adhesive tape.

3. The dispenser according to claim 1, wherein
- the drive installation has a drive wheel with a rotating motion which is driven by a drawing-off movement of the first adhesive tape, the second adhesive tape, or the two-ply adhesive tape, the rotating motion of said drive wheel being transmitted to the storage roll by means of a gear.

4. The dispenser according to claim 1, further comprising:

a cutting installation in which the two-ply adhesive tape having the liner disposed thereon, prior to being applied to the substrate, is cut in a dual-stage cutting process wherein, the two-ply adhesive tape including the liner disposed thereon is cut off in a first cutting step, and only the two-ply adhesive tape is cut off in a second cutting step.

5. The dispenser according to claim 1, further comprising:

an adhesive tape accumulator by way of which the first adhesive tape and the second adhesive tape are guided after having been connected to form the two-ply adhesive tape and prior to being applied to the substrate.

6. The dispenser according to claim 5, wherein the adhesive tape accumulator is formed by a chicane that intentionally increases a running length between the connection installation and the application installation or by a second storage roll.

7. The dispenser according to claim 1, further comprising:

a timer which displays the time span between connecting the two adhesive tapes and applying the two-lay adhesive tape.

* * * * *